US010729223B2

(12) United States Patent
Weaver

(10) Patent No.: US 10,729,223 B2
(45) Date of Patent: Aug. 4, 2020

(54) MODULAR APPARATUS FOR INCREASING NUMBER OF ELECTRICAL SOCKETS AND ORGANIZING HAIR CARE ITEMS

(71) Applicant: Jason C. Weaver, Austin, TX (US)

(72) Inventor: Jason C. Weaver, Austin, TX (US)

( * ) Notice: Subject to any disclaimer, the term of this patent is extended or adjusted under 35 U.S.C. 154(b) by 36 days.

(21) Appl. No.: 16/007,536

(22) Filed: Jun. 13, 2018

(65) Prior Publication Data

US 2018/0360197 A1 Dec. 20, 2018

Related U.S. Application Data

(60) Provisional application No. 62/519,843, filed on Jun. 14, 2017.

(51) Int. Cl.

| | |
|---|---|
| ***A45D 44/02*** | (2006.01) |
| ***A45D 44/06*** | (2006.01) |
| ***A45D 20/12*** | (2006.01) |
| ***A45D 1/00*** | (2006.01) |
| ***A45D 2/00*** | (2006.01) |
| ***H01R 25/00*** | (2006.01) |
| ***A45D 20/00*** | (2006.01) |
| ***A45D 44/04*** | (2006.01) |
| *A45D 1/20* | (2006.01) |
| *A47F 7/00* | (2006.01) |
| *A45D 20/16* | (2006.01) |

(52) U.S. Cl.

CPC ..... *A45D 44/02* (2013.01); *A45D 1/00* (2013.01); *A45D 2/001* (2013.01); *A45D 20/00* (2013.01); *A45D 44/04* (2013.01); *H01R 25/006* (2013.01); *A45D 1/20* (2013.01); *A45D 20/12* (2013.01); *A45D 20/16* (2013.01); *A45D 2001/002* (2013.01); *A47F 7/0028* (2013.01)

(58) Field of Classification Search

CPC ..... A45D 44/02; A45D 1/00; A45D 2/001; A45D 20/00; A45D 2001/002; A45D 1/20; A45D 20/12; A45D 20/16; A45D 44/06; H01R 25/006; A45F 7/0028

See application file for complete search history.

(56) References Cited

U.S. PATENT DOCUMENTS

| | | | | |
|---|---|---|---|---|
| 4,898,309 A * | 2/1990 | Fischer | A47G 25/904 | 223/111 |
| 5,727,701 A * | 3/1998 | Rhoades | A45D 1/00 | 211/70.6 |
| 5,743,415 A | 4/1998 | Smart | | |
| 5,794,799 A * | 8/1998 | Collins | A45D 1/20 | 211/60.1 |
| 5,917,694 A | 6/1999 | Denny | | |
| 6,123,299 A | 9/2000 | Zach, Sr. | | |

(Continued)

*Primary Examiner* — Tan Le

(74) *Attorney, Agent, or Firm* — Diederiks & Whitelaw, PLC.

(57) ABSTRACT

A hair care organizing apparatus includes a wall tap and an organizer unit attached to the wall tap. The wall tap has a plug that is inserted into a socket of an electrical outlet. The wall tap also has at least one electrical socket that receives a plug of an electrically-powered device. The organizer unit has at least first and second holders for receiving and supporting distinct hair care accessories. The first holder is intended for a hair dryer. In use, the hair dryer is plugged into the at least one electrical socket and inserted into the first holder to support the hair dryer from the organizer unit.

18 Claims, 14 Drawing Sheets

(56) References Cited

U.S. PATENT DOCUMENTS

| | | | | |
|---|---|---|---|---|
| D442,916 | S | 5/2001 | Tong et al. | |
| D487,170 | S | 2/2004 | Petruccelli | |
| 6,769,554 | B1 | 8/2004 | Udofiah | |
| 6,844,494 | B1 * | 1/2005 | Nevins | H01R 25/003 174/135 |
| D814,420 | S | 4/2018 | Chen | |
| D850,727 | S * | 6/2019 | Petruccelli | D28/73 |
| 2003/0222069 | A1 * | 12/2003 | Sena | A45D 1/20 219/222 |
| 2004/0209514 | A1 | 10/2004 | Marshall Yoe et al. | |
| 2009/0057507 | A1 | 3/2009 | Ventura | |
| 2010/0012344 | A1 * | 1/2010 | Dannenberg | A45D 20/12 174/53 |
| 2012/0324755 | A1 * | 12/2012 | Zhao | A47K 10/48 34/427 |

* cited by examiner

MODULAR APPARATUS FOR INCREASING NUMBER OF ELECTRICAL SOCKETS AND ORGANIZING HAIR CARE ITEMS

BACKGROUND OF THE INVENTION

The present invention pertains to a hair care organizing apparatus and, more particularly, to a hair care organizing apparatus having an organizer unit attached to a wall tap.

For many people, counterspace and electrical outlets are at a premium in locations such as bathrooms and hair salons where multiple electrical devices might be used on a regular basis. In addition to the electrical devices, a wide variety of grooming products can often be found on such counters. For example, when preparing for the day, a person might use one or more dental care products, one or more skin care products, one or more makeup products and one or more hair care products, as well as an electric toothbrush, a hair dryer and a curling iron or hair straightener, on a bathroom countertop. For this reason, it would be desirable to provide a way to reduce clutter, disorganization and counterspace use in a bathroom, hair salon, or the like, while adding more electrical outlets.

SUMMARY OF THE INVENTION

The present invention achieves the above goal by leveraging an existing electric outlet as both a source for electricity and as a mounting mechanism for a storage system that can hold and organize small personal items and add additional new electrical outlets. In particular, a hair care organizing apparatus comprises a wall tap and an organizer unit attached to the wall tap. The wall tap includes a plug configured to be inserted into a socket of an electrical outlet. The wall tap further includes at least one electrical socket configured to receive a plug of an electrically-powered device. The organizer unit includes at least first and second holders configured to receive and support distinct hair care accessories. The first holder is configured for a hair dryer. In use, the hair dryer is plugged into the at least one electrical socket and inserted into the first holder to support the hair dryer from the organizer unit.

Additional objects, features and advantages of the invention will become more readily apparent from the following detailed description of preferred embodiments thereof when taken in conjunction with the drawings wherein like reference numerals refer to common parts in the several views.

DETAILED DESCRIPTION OF THE INVENTION

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to employ the present invention. In addition, as used in connection with the present invention, terms such as "horizontal" and "vertical" do not necessarily require that the relevant structure be perfectly horizontal or vertical. Instead, these terms are intended to encompass structure that is sufficiently horizontal or vertical so as to function essentially the same as structure that is perfectly horizontal or vertical.

For purposes of the present invention, "outlet" refers to a standard source of electricity typically embedded into a wall and configured as a pair of sockets. "Plug" refers to the male-sided mating mechanism for a socket, like that found on the side of an extension cord that plugs into an outlet, and is typically configured as two or three protruding prongs made of conductive material. "Socket" refers to a grouping of holes, generally two or three, that makes up the female or receiving end of a plug-and-socket pair. "Male" refers to the side of a matched male-and-female pair that has protruding prongs that can be inserted into matched receptacles. "Female" refers to the side of a matched male-and-female pair that has receptacles that can accept protruding prongs. "GFCI" means ground fault circuit interrupter. "Personal items" includes, but is not limited to, hair dryers, hair brushes, toothbrushes, earrings, finger rings, necklaces, flat hair irons (or hair straighteners), curling irons, makeup brushes, tweezers, eyebrow shapers and eyebrow brushes.

Overview

Figure 1:
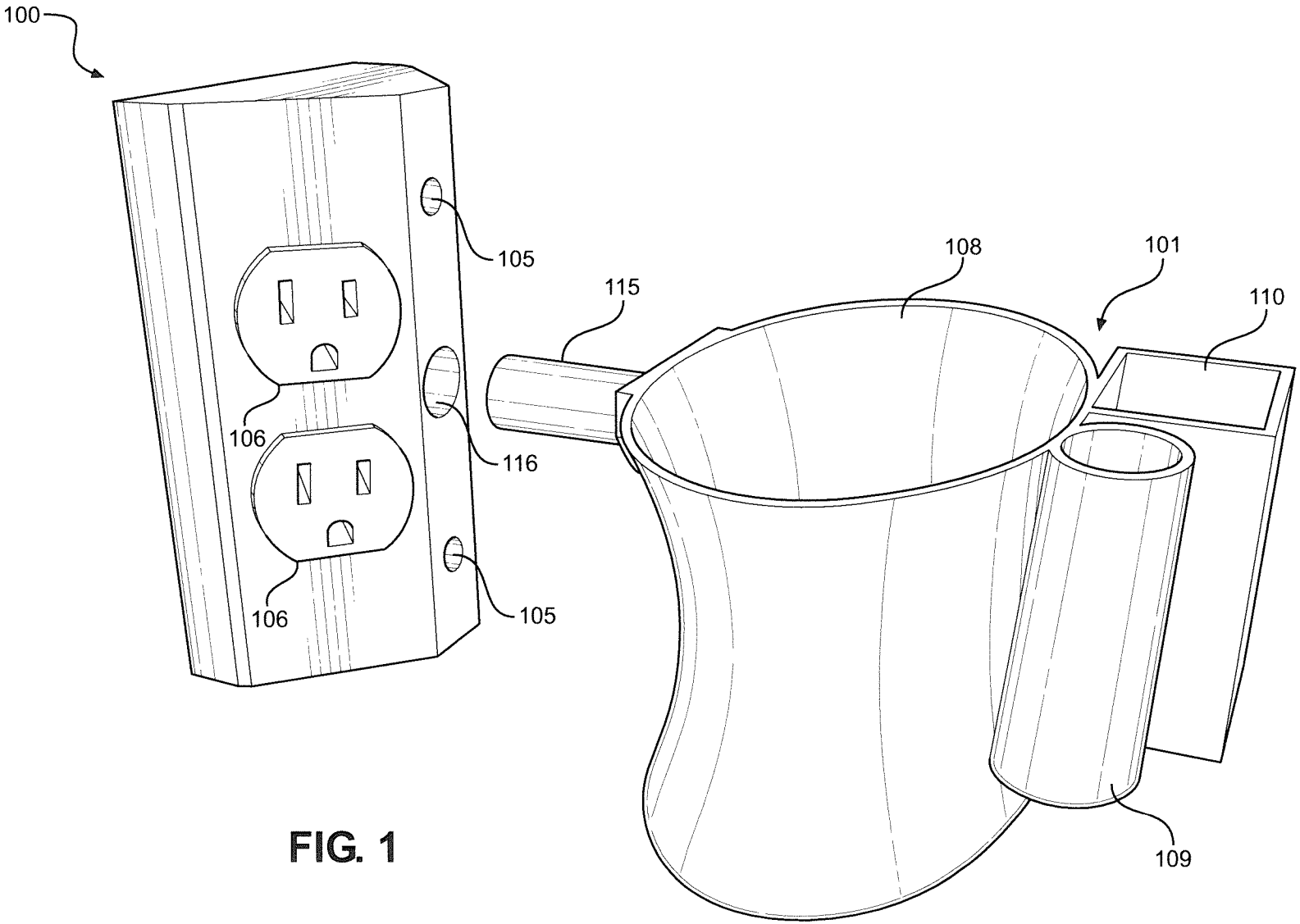
FIG. 1 is an exploded perspective front view of a hair care organizing apparatus constructed in accordance with a first embodiment of the present invention.
Figure 2:
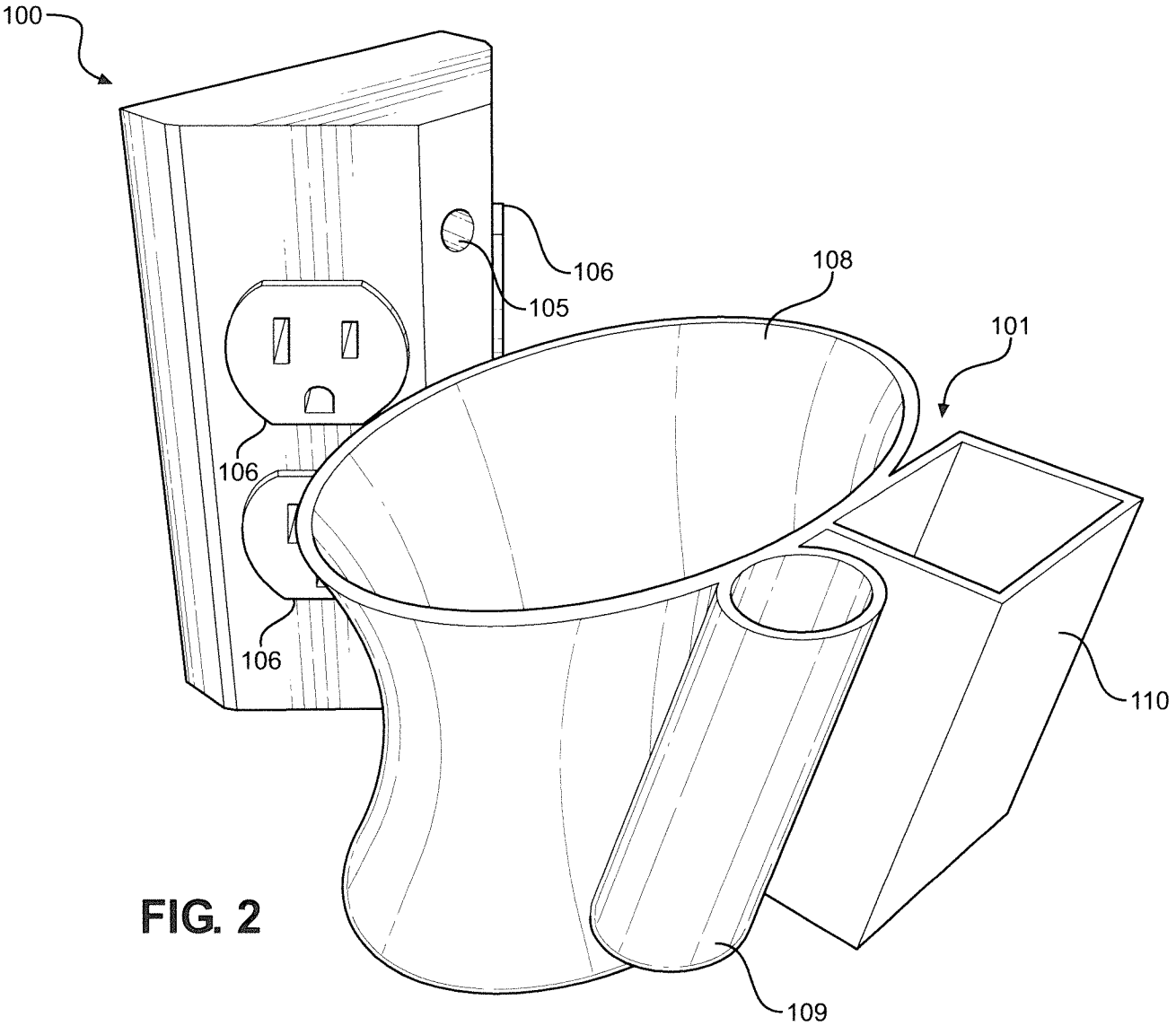
FIG. 2 is a perspective front view of the hair care organizing apparatus.
Figure 3:
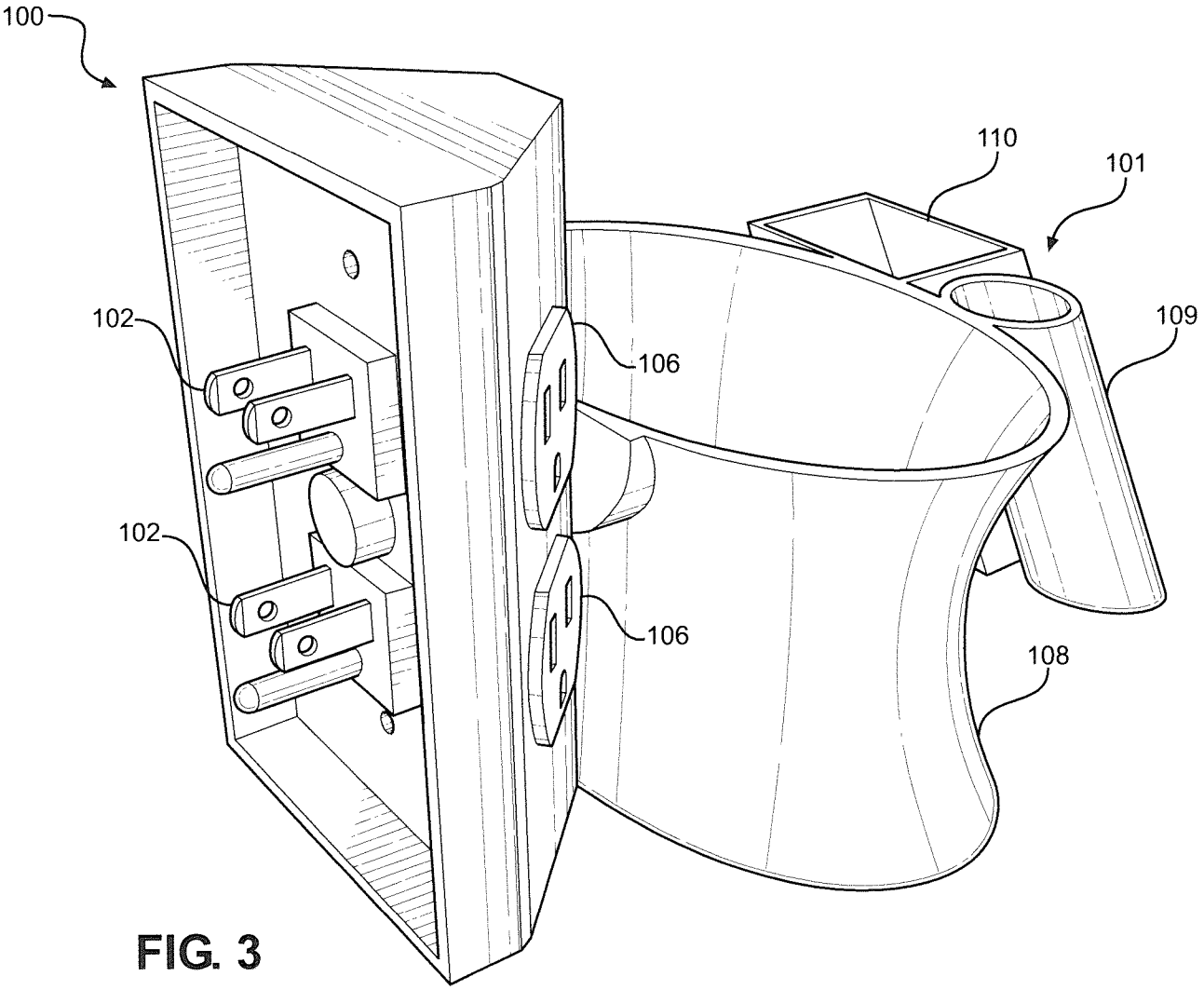
FIG. 3 is a perspective rear view of the hair care organizing apparatus.
Figure 4:
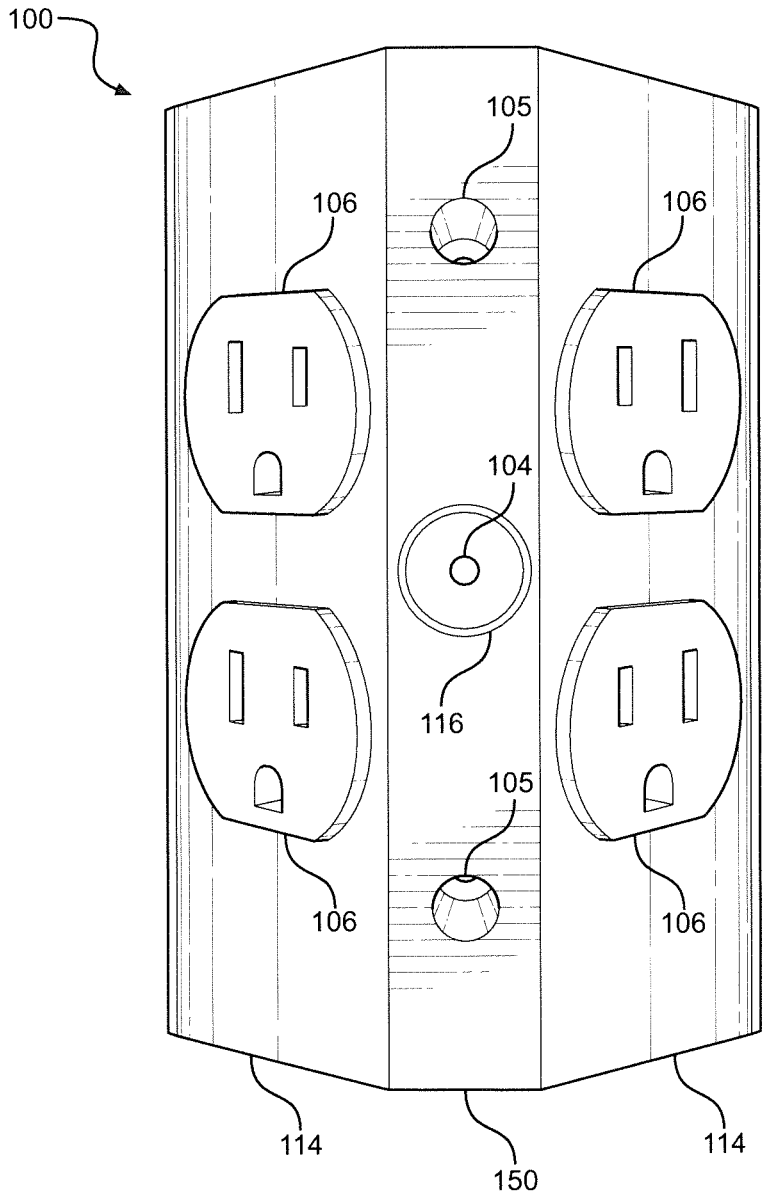
FIG. 4 is a front view of a wall tap of the hair care organizing apparatus.
Figure 5:
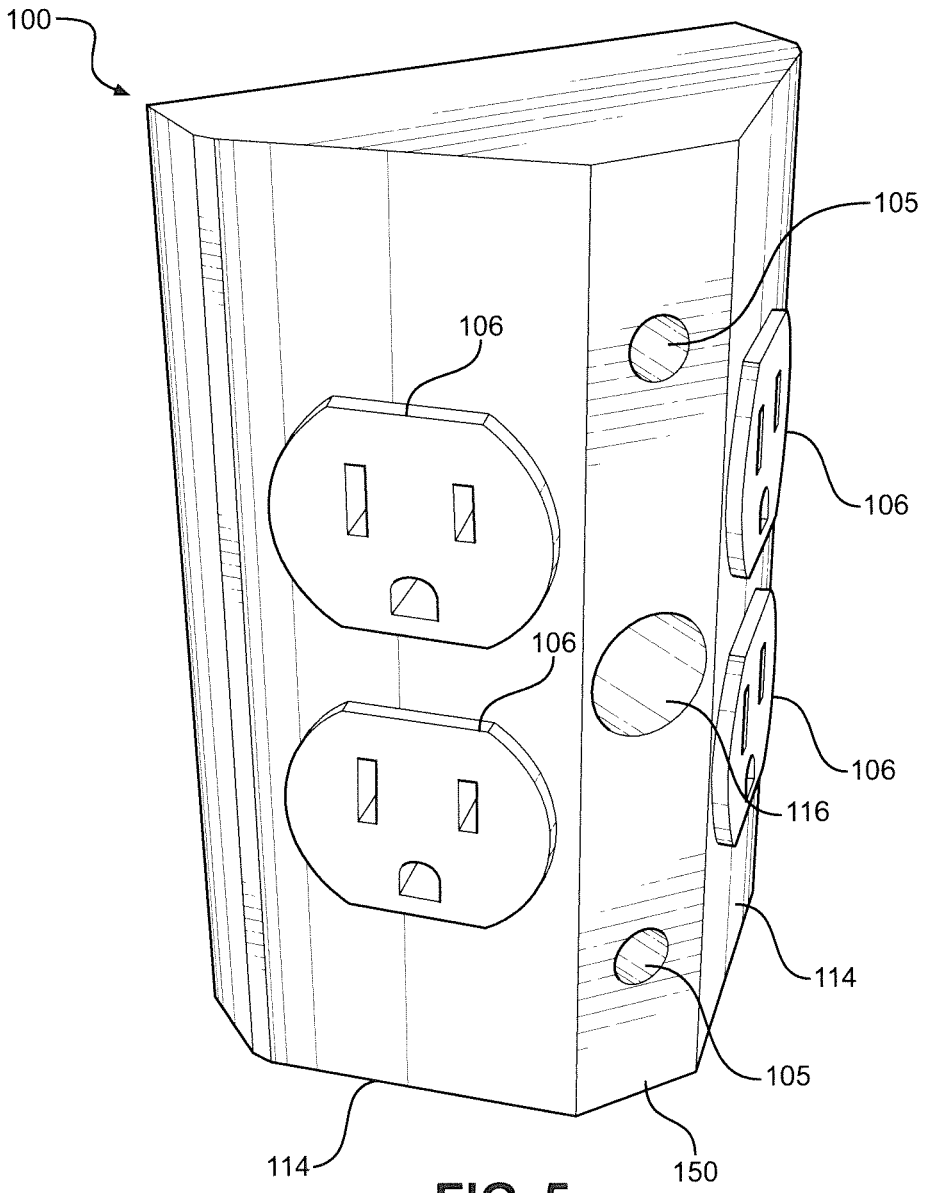
FIG. 5 is a front perspective view of the wall tap.
Figure 6:
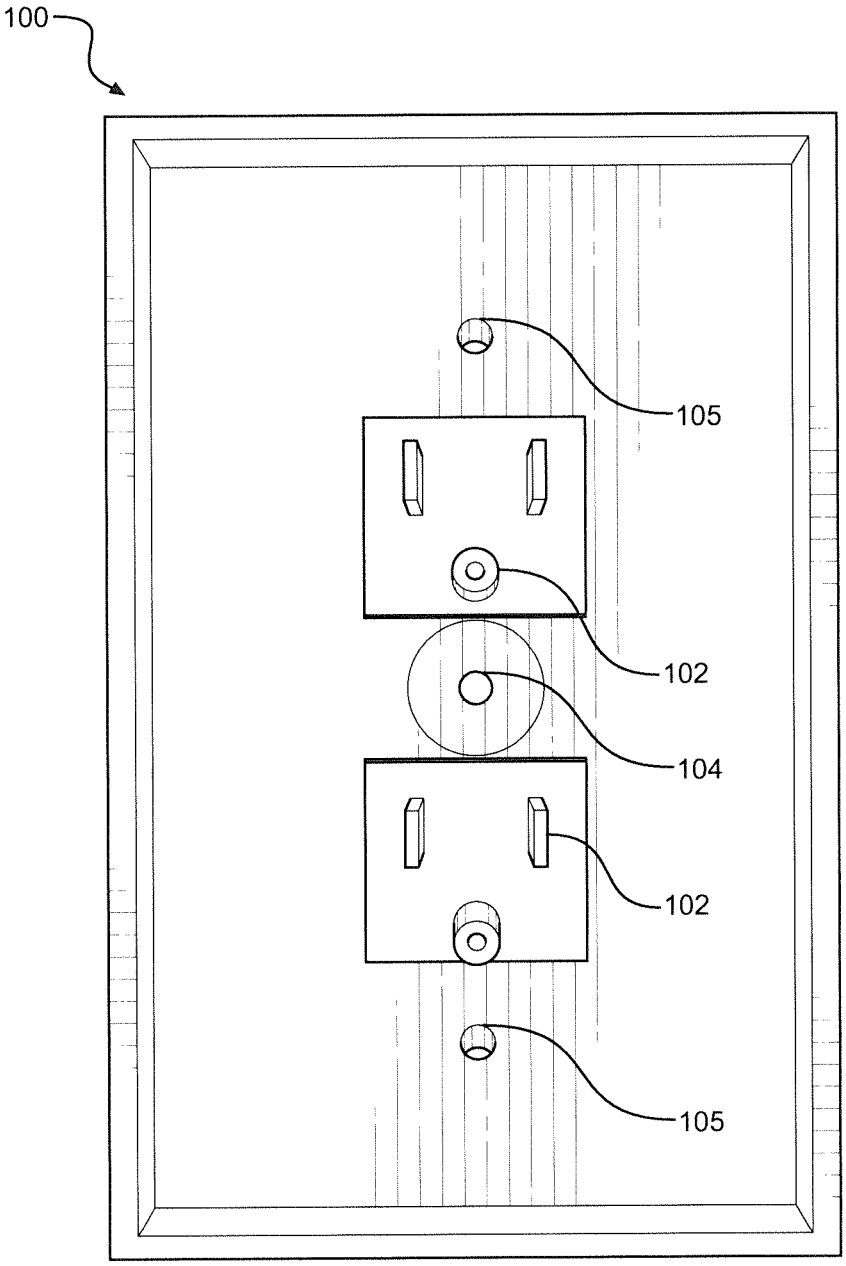
FIG. 6 is a rear view of the wall tap.
Figure 7:
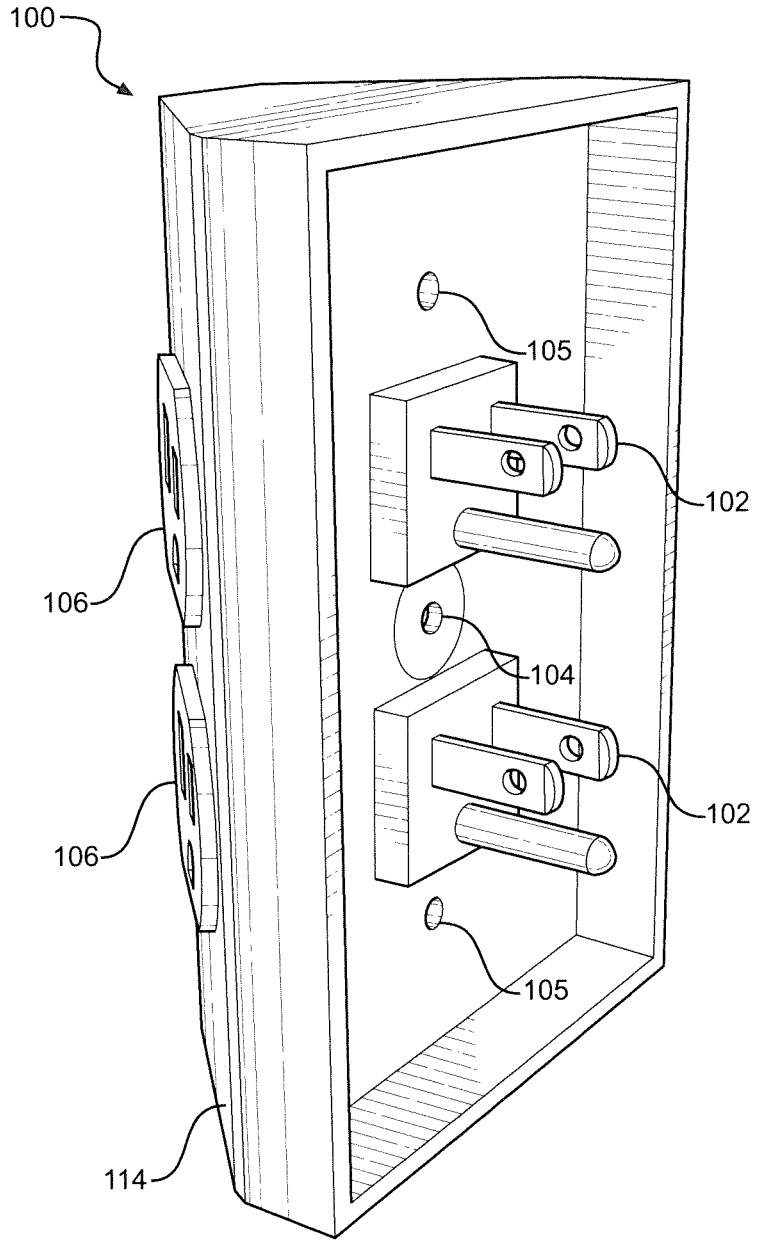
FIG. 7 is a rear perspective view of the wall tap.

The invention is directed to a modular system that acts as a grooming item organizer and electrical outlet expansion block. A first embodiment of the invention is shown in FIGS. 1-12. The first embodiment comprises a device that holds and organizes one or more hair care items while also increasing the number of available electrical sockets from the typical two provided by a standard wall outlet 111 (shown in FIG. 8) to four or more sockets 106 (as can be seen in FIG. 4). No physical installation or mounting is required. The holding force from the mating of the wall female electrical outlet sockets and male electrical plugs 102 embedded in the device provides significant holding force to keep the device firmly in place.

In a preferred embodiment, the device is comprised of two modules: a wall mount (or wall tap) 100 and an organizer (or organizer unit) 101. Wall mount 100 mounts to an existing outlet 111, includes one or more outward-facing sockets 106 and transfers electricity from outlet 111 to outward-facing sockets 106. Organizer 101 mounts to wall mount 100 and includes one or more holders for storing personal items. Wall mount 100 can support one or more organizers 101.

The Wall Mount

Wall mount 100 attaches to a standard outlet 111 or GFCI electrical outlet like those commonly found in bathrooms. Wall mount 100 has male plugs 102 that protrude from the rear of wall mount 100 such that male plugs 102 plug directly into outlet 111 and wall mount 100 is held firmly by friction between male plugs 102 and outlet 111. Specifically, plugs 102 are inserted into corresponding sockets of outlet 111.

Figure 8:
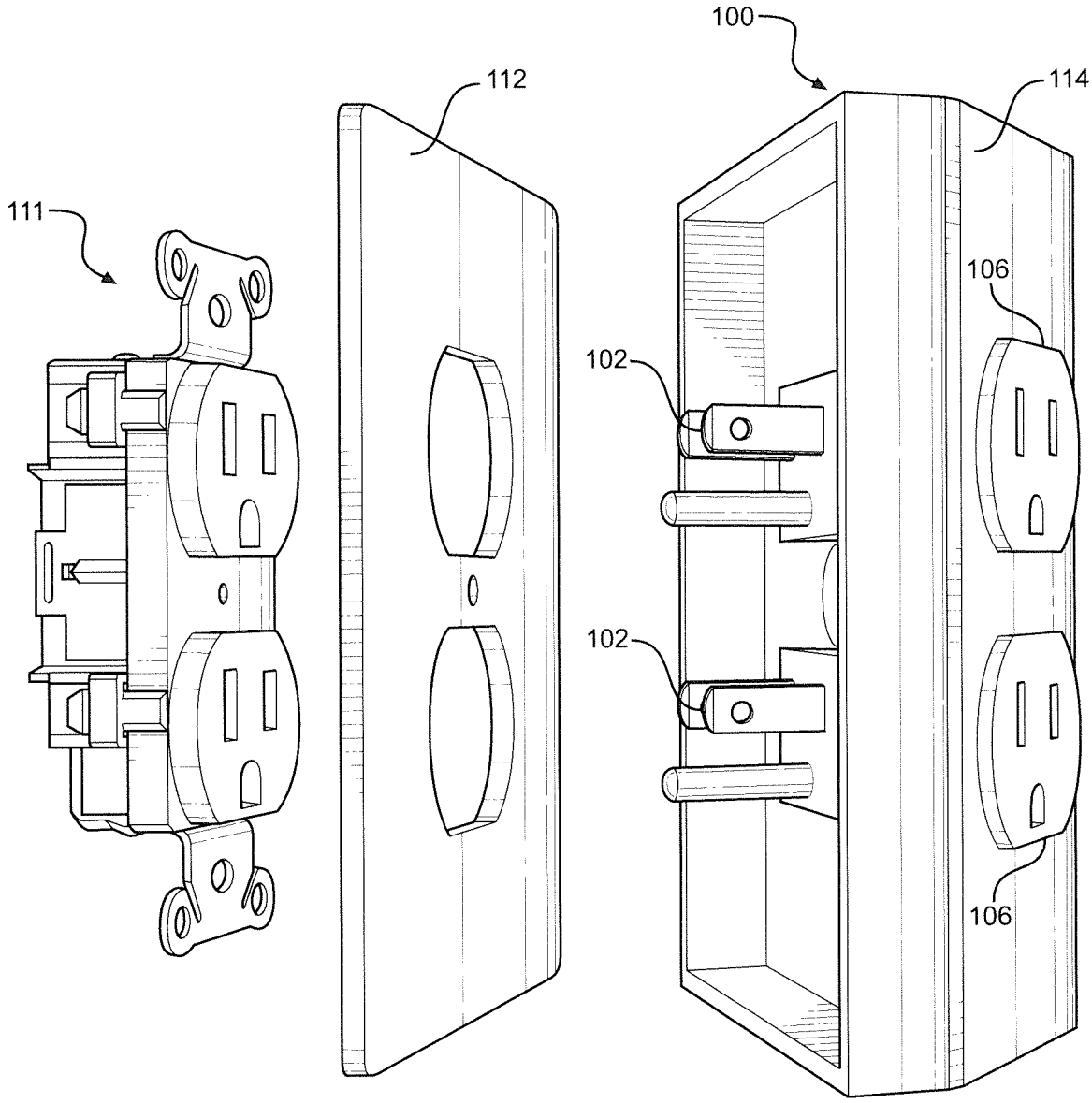
FIG. 8 is an exploded view of the wall tap installed in an electrical outlet.
Figure 9:
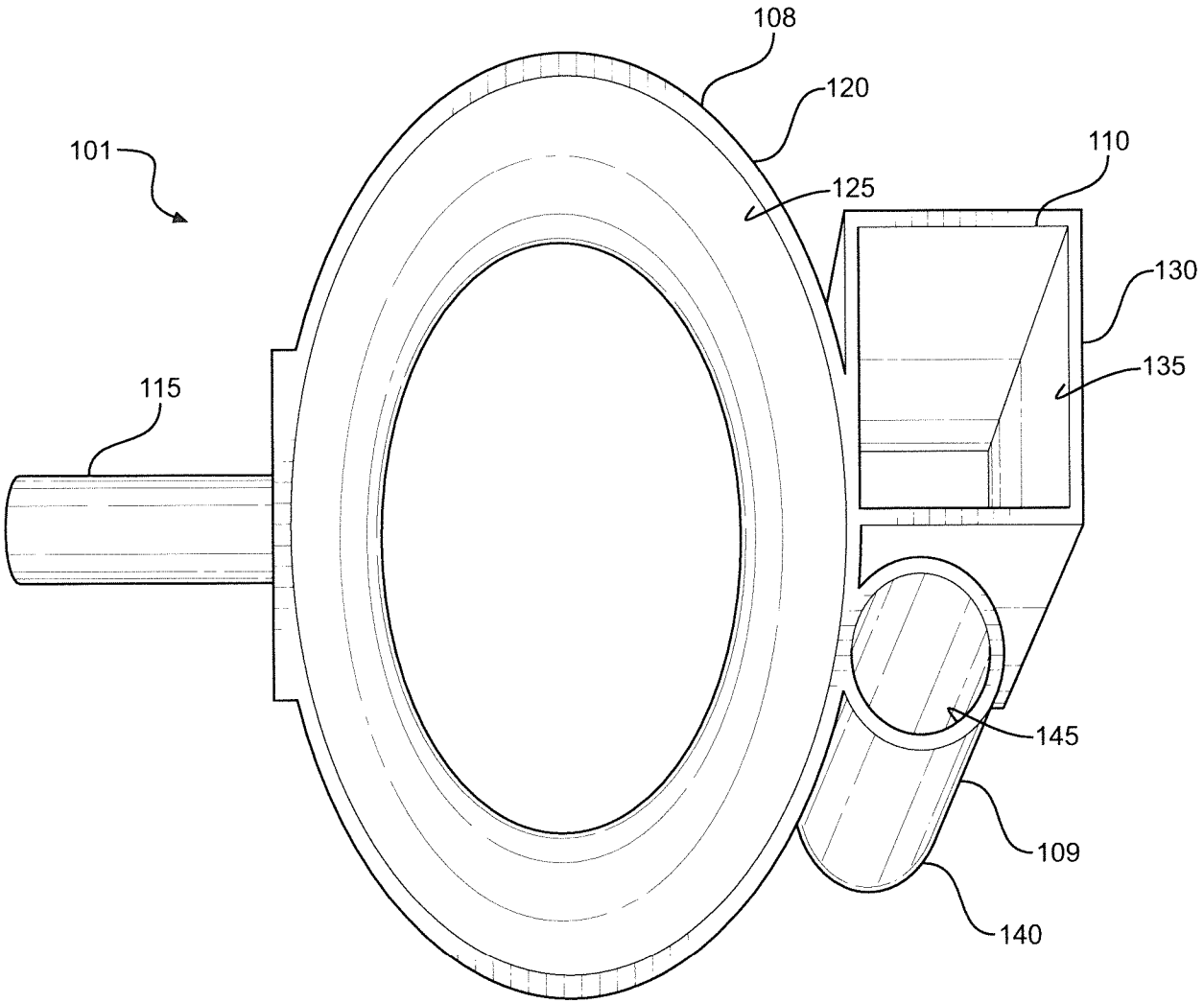
FIG. 9 is a top view of an organizer unit of the hair care organizing apparatus.
Figure 10:
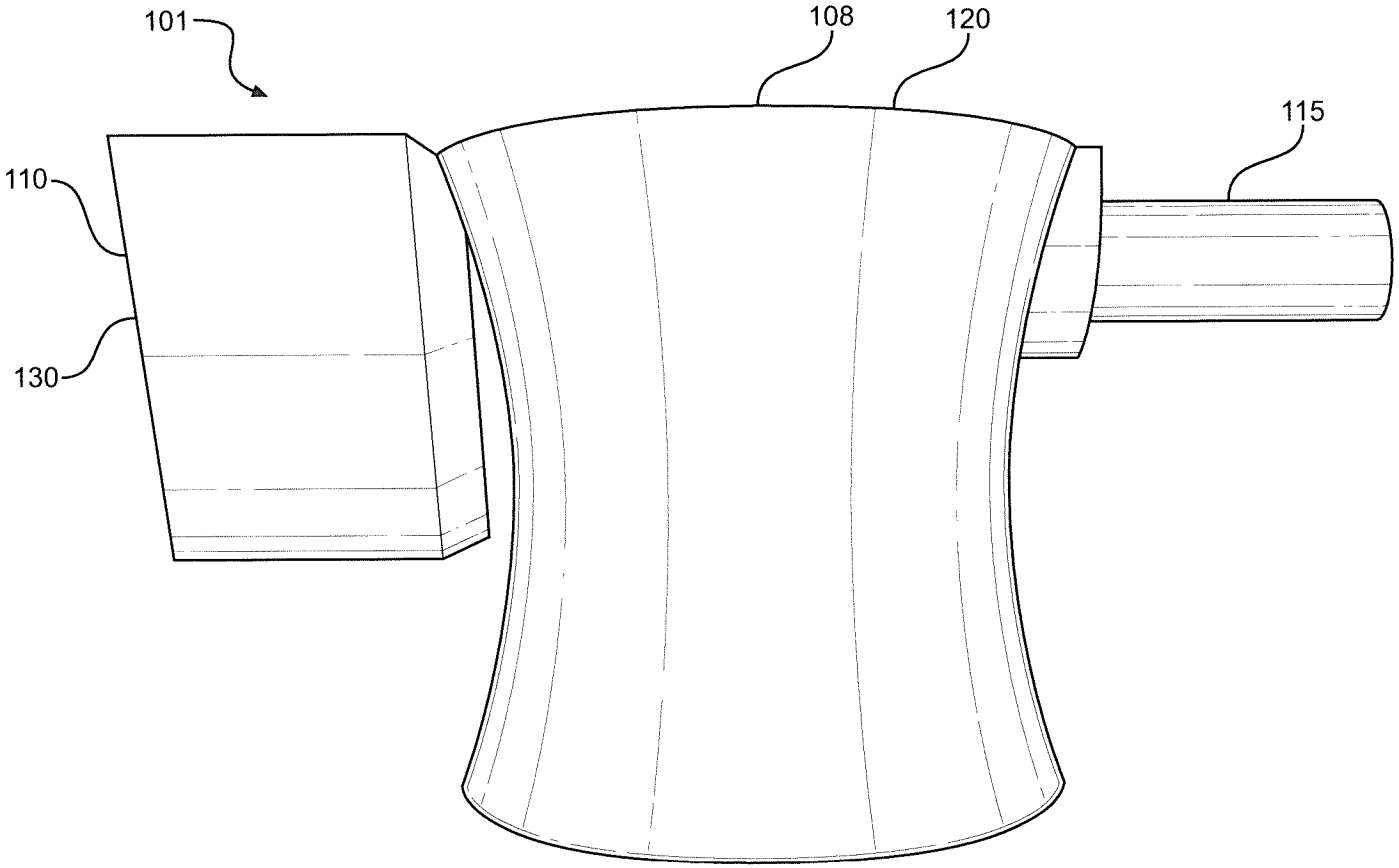
FIG. 10 is a side view of the organizer unit.
Figure 11:
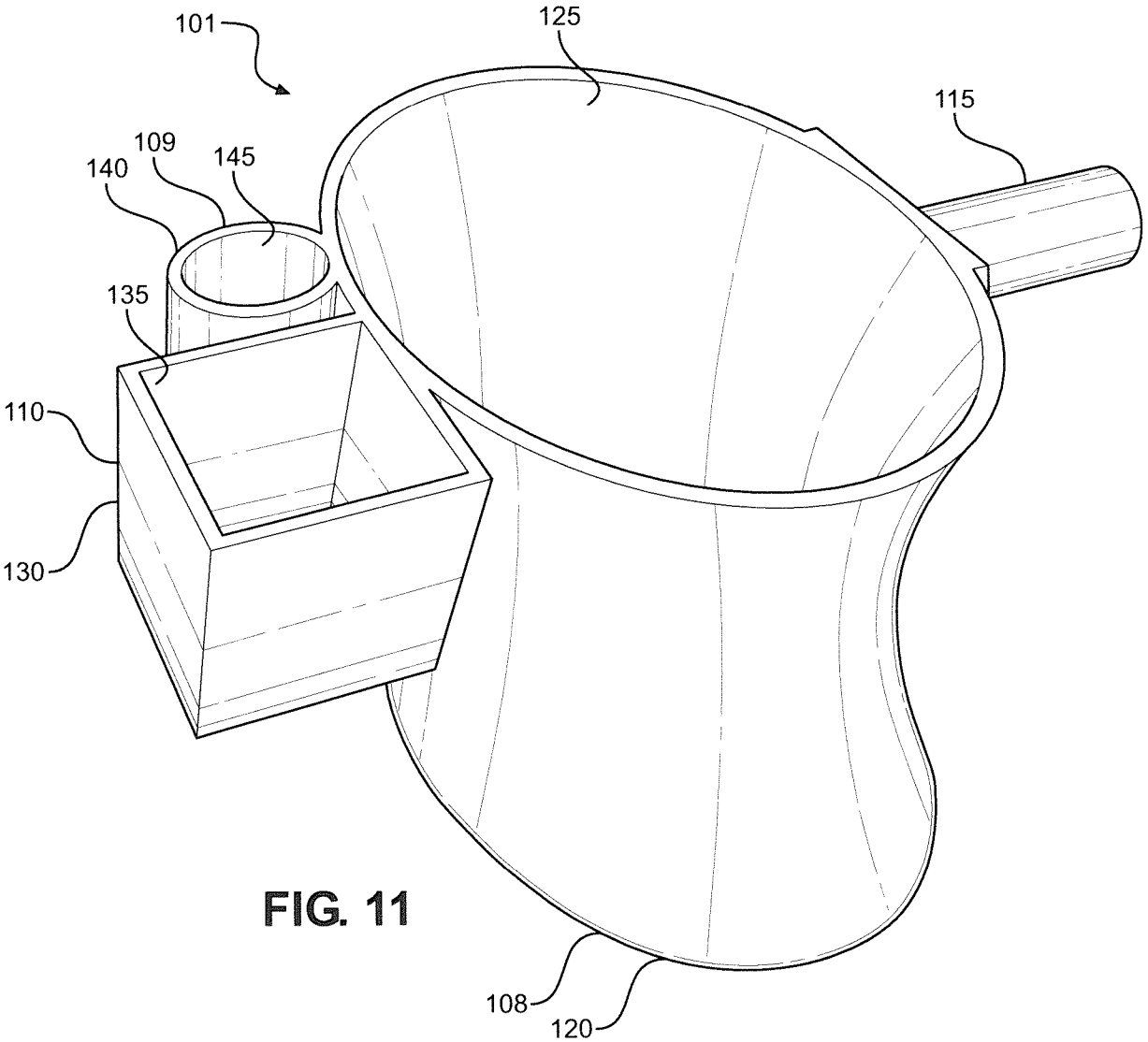
FIG. 11 is a perspective view of the organizer unit.

In one embodiment, wall mount 100 has a complete three-prong plug 102 that mates with the top three-hole socket of outlet 111 and another three-prong plug 102 that mates with the bottom three-hole socket of outlet 111 such that both sockets that make up outlet 111 are fully engaged with the two plugs 102 of wall mount 100, as can be seen in FIG. 8. In another embodiment, wall mount 100 has a complete three-prong plug 102 that mates with the top three-hole socket of outlet 111 and an additional single protruding prong that mates with the bottom ground hole in outlet 111 such that wall mount 100 mates with outlet 111 with four points of contact: all three holes for the first socket of outlet 111 and only the ground hole for the second socket of outlet 111. Of course, it should also be recognized that plugs 102 can be configured to work with other types of outlets, such as those found outside the United States.

Wall mount 100 can be configured to attach semi-permanently to electrical outlet 111 with mounting screws. One embodiment of wall mount 100 has three optional mounting screw holes that can be used to attach the device. A center hole 104 can be used to attach the device using the screw typically used to attach a wall plate 112 to outlet 111 (shown in FIG. 8). That is, wall mount 100 is configured such that hole 104 is aligned with a hole of outlet 111 when plugs 102 are inserted into the sockets of outlet 111, with the screw being inserted through hole 104 into the hole of outlet 111 to secure wall mount 100 to outlet 111. The two spaced holes in wall mount 100 located further from the center, labeled 105, can be used to attach wall mount 100 to outlet 111 after the removal of wall plate 112. Specifically, holes 105 are configured to be aligned with corresponding threaded holes of outlet 111 when plugs 102 are inserted into the sockets of outlet 111. A pair of screws (not shown) can be inserted into holes 105 and into the threaded holes of outlet 111 to secure wall mount 100 to outlet 111. The inclusion of holes 104 and 105 is optional in that wall mount 100 can mount to outlet 111 using plugs 102 alone, as discussed above. Accordingly, even when holes 104 and 105 are included, use of these holes by the end user (i.e., the consumer) is optional. Likewise, wall plate 112 does not need to be removed to install wall mount 100. Therefore, wall mount 100 is preferably configured to fit over wall plate 112, as in the embodiments shown.

In addition to the connection between outlet 111 and male electrical plugs 102, other mechanisms for securing the device to wall plate 112 include, but are not limited to, double-sided tape, foam tape, Velcro and epoxy.

Figure 12:
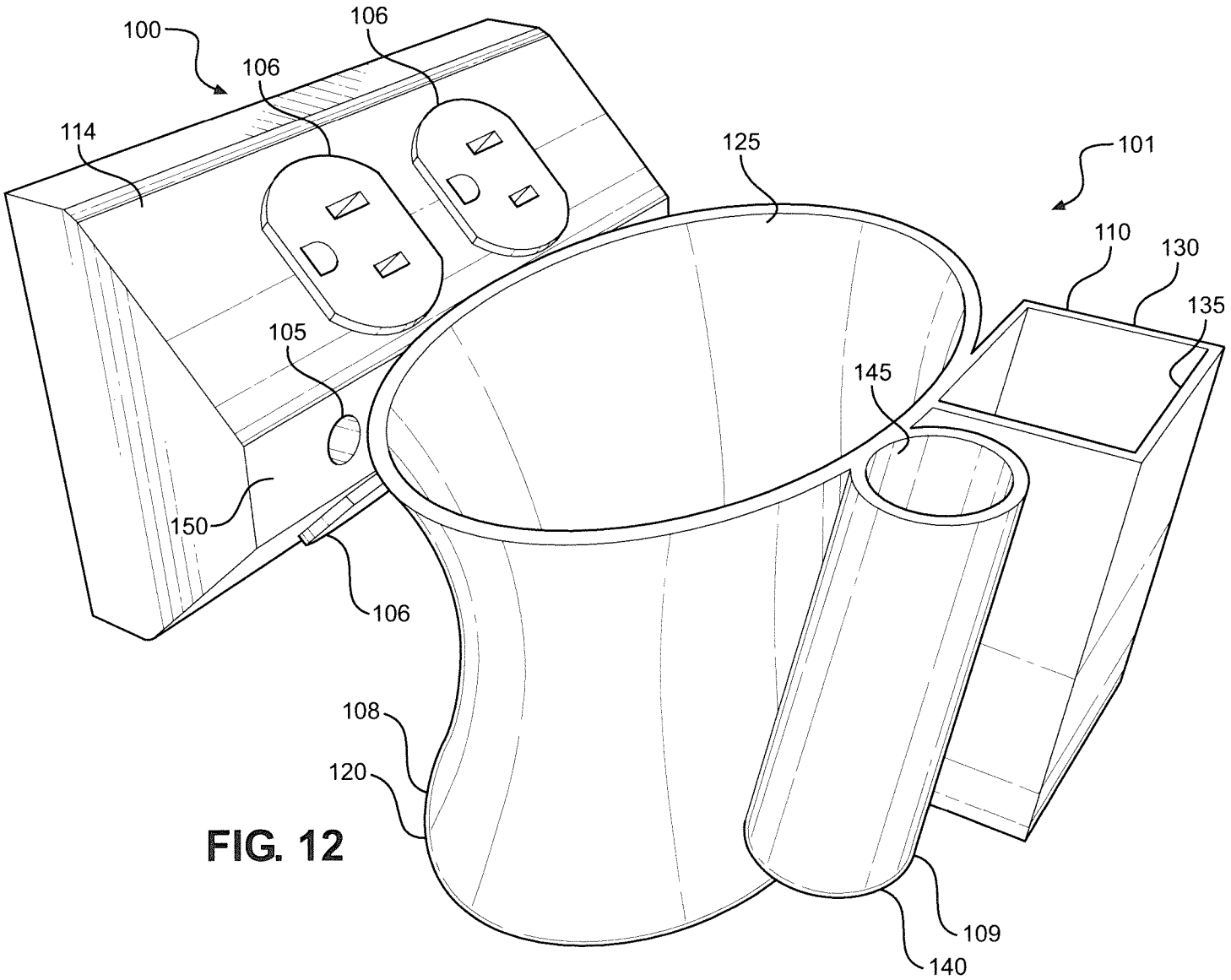
FIG. 12 is a perspective front view of the hair care organizing apparatus installed in a horizontal orientation.

Wall mount 100 can be attached to either a horizontally configured outlet 111 or a vertically configured outlet 111. FIGS. 1-3 and 8 show wall mount 100 installed onto a vertically configured outlet 111, while FIG. 12 shows wall mount 100 installed onto a horizontally configured outlet 111.

Figure 13:
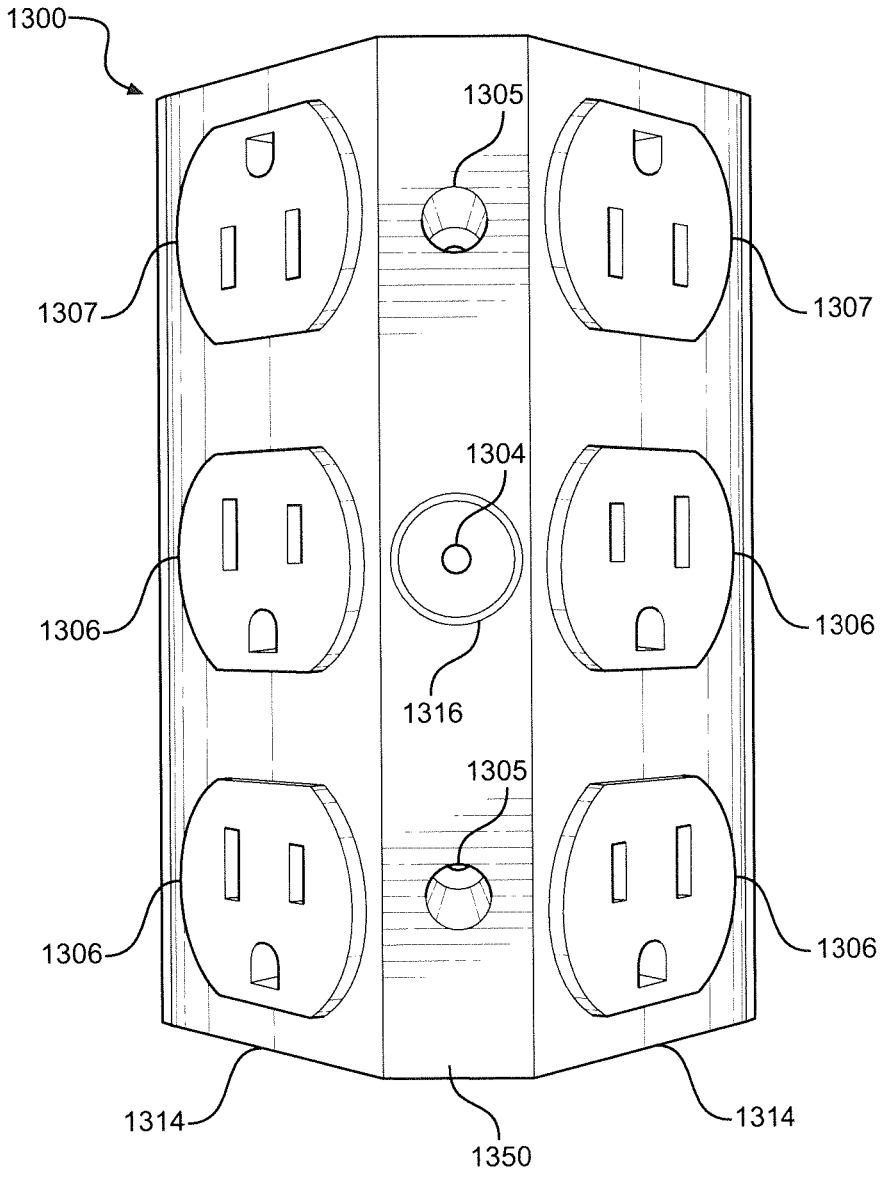
FIG. 13 is a front view of a wall tap constructed in accordance with a second embodiment of the present invention.

Wall mount 100 includes one or more sockets 106, on the outward facing side or sides, that provide additional access to electricity. Specifically, each socket 106 is configured to receive a plug of an electrically-powered device, with power being transferred from outlet 111 to the electrically-powered device through the corresponding socket 106. FIGS. 1-8 and 12 show one embodiment where wall mount 100 provides four sockets 106. Other embodiments can include more or fewer sockets 106. FIG. 13 shows an embodiment where a wall mount 1300 includes six sockets: four sockets 1306 and two sockets 1307. One or more of the sockets can be rotated radially (see sockets 1307) to allow for the insertion of plugs that have been rotated out of sequence from the other plugs. Otherwise, wall mount 1300 is constructed in substantially the same manner as wall mount 100. As such, wall mount 1300 includes holes 1304 and 1305, sides 1314, an attachment point 1316 and a side 1350.

Wall mount 100 has sides 114 that are angled to increase the available surface area so that more sockets 106 can be added (relative to outlet 111). That is, wall mount 100 has a plurality of facets, including at least a wide facet and a narrow facet that are angled relative to one another. Sides 114 constitute wide facets, with sockets 106 being located on sides 114. A side 150 constitutes a narrow facet, with organizer 101 being attached to wall mount 100 along side 150. Each socket 106 is surrounded with enough distance to allow for the large plugs often found on hair dryers and curling irons to fit side-by-side without interference from other large plugs.

In one embodiment, wall mount 100 includes a power switch that turns off one, some or all sockets 106 contained in wall mount 100. In one embodiment, wall mount 100 includes a light-emitting diode (LED) status indicator to show that power on or off status.

In one embodiment, a fuse protection circuit is included for safety. In one embodiment, a timer circuit is included that shuts off one, some or all the embedded sockets 106 after a certain time has elapsed. In one embodiment, sockets 106 in wall mount 100 are GFCI enabled, or the main circuit for wall mount 100 is a single GFCI circuit.

In one embodiment, wall mount 100 includes one or more USB-type sockets that can be used to power or charge devices, like personal phones. In one embodiment, wall mount 100 includes a power usage measurement circuit and a display to show how much power is currently being consumed by wall mount 100 and the devices plugged into sockets 106 of wall mount 100.

The Organizer

Organizer 101 includes one or more slots, holes, crevices, hangers or other holders that can be used for organizing personal items. Preferably, organizer 101 includes at least first and second holders that are configured to receive and support distinct hair care accessories (e.g., hair styling tools). FIGS. 1-3 and 9-12 show an embodiment of organizer 101 that includes a hair dryer holder 108, a flat iron (or hair straightener) holder 110 and a curling iron holder 109, while still allowing wall unit 100 to expand the available electrical sockets from two to four.

Preferably, hair dryer holder 108 has a simple tubular member 120, defining a passageway 125, that can be used to store a hair dryer (not shown) by inserting the air exit nozzle portion of the hair dryer into tubular member 120 such that the hair dryer nozzle portion extends all the way through passageway 125, with tubular member 120 supporting the body of the hair dryer. Simultaneously, the hair dryer power cord can be plugged into one of sockets 106 provided by wall mount 100.

Similarly, flat iron holder 110 has a member 130, defining a passageway 135, that can be used to store a flat iron or hair straightener (not shown) by inserting the iron portion of the flat iron or hair straightener into member 130 such that the iron portion extends all the way through passageway 135, with member 130 supporting the body (or handle) of the flat iron or hair straightener. The power cord for the flat iron or hair straightener can be plugged into one of sockets 106.

Likewise, curling iron holder 109 has a member 140, defining a passageway 145, that can be used to store a curling iron (not shown) by inserting the iron portion of the curling iron into member 140 such that the iron portion extends all the way through passageway 145, with member 140 supporting the body (or handle) of the curling iron. The power cord for the curling iron can be plugged into one of sockets 106.

Organizer 101 can be made of hard plastic, heat resistant plastic, lightweight metal or a combination of several materials.

Attaching the Wall Mount to the Organizer

Wall Mount 100 has one or more attachment points which are used to join wall mount 100 and organizer 101 such that, once wall mount 100 and organizer 101 are joined, wall mount 100 and organizer 101 are effectively one unit until specific steps are taken to unjoin them.

In some embodiments, organizer 101 is designed to function most effectively in a single directional configuration only, either vertically or horizontally. As discussed above, wall mount 100 can be installed in either a vertical or horizontal wall outlet. To enable organizer 101 to be placed in its most useful orientation regardless of the directional configuration of wall mount 100, wall mount 100 has one or more attachment points (or couplers) 116, and organizer 101 has one or more attachment points (or couplers) 115 that enable organizer 101 to be positioned in the most effective position, no matter how wall mount 100 is installed. Specifically, attachment points 115 and 116 are interconnected to removably support organizer 101 from wall mount 100, with organizer 101 cantilevered from wall mount 100.

In some embodiments, one or more organizers 101 can be attached to wall mount 100 in other locations, such as the top plane of wall mount 100. In those embodiments, wall mount 100 has attachment point or points 115 that can join with the organizer attachment point or points 116, thereby allowing the one or more organizers 101 to be positioned in the most effective positions, no matter how wall mount 100 is installed. The joining of wall mount 100 and organizer 101 no matter the wall mount installation direction (horizontal or vertical) provides organization and storage of personal items in an obvious and intuitive way.

Organizer 101 can attach to wall mount 100 at the top and comprise a metal rod or wire that extends upward and ends with a hook that can be used to suspend a ring, necklace or other personal item. In another embodiment, organizer 101 can comprise a metal rod that attaches to and extends upwards from wall mount 100 and then branches out into several extending hooks so that several rings, necklaces or other personal items can be suspended from the hooks.

In the embodiment of FIGS. 1-12, the attachment point is a matched rod-and-hole set where rod (or projection) 115 protrudes from organizer 101 and wall mount 100 includes the matched hole 116 positioned such that rod 115 can be inserted into hole 116 to join organizer 101 and wall mount 100, with rod 115 snugly received in hole 116. In another embodiment with a matched rod-and-hole set, rod 115 protrudes from wall mount 100 and hole 116 is included in organizer 101.

Figure 14:
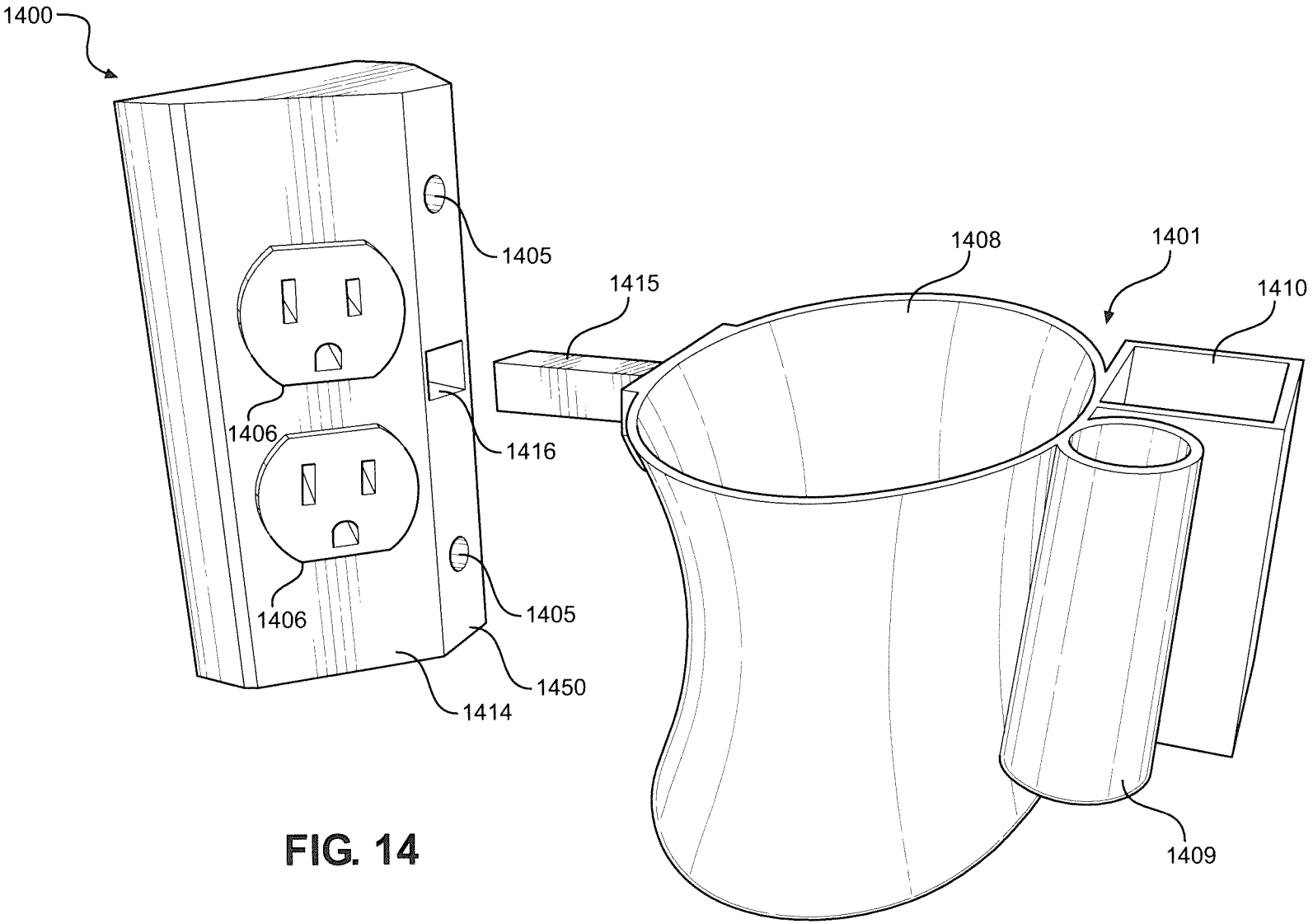
FIG. 14 is an exploded perspective front view of a hair care organizing apparatus constructed in accordance with a third embodiment of the present invention.

In some embodiments, hole 116 is a keyed hole, such as one of ordinary skill in the art of mechanical design would understand, and rod 115 is keyed such that, once rod 115 is inserted into hole 116, organizer 101 and wall mount 100 are prevented from independent rotation about the axis of rod 115. In some embodiments, rod 115 and hole 116 are configured so as to restrict the ways rod 115 and hole 116 can be joined. One example of such an embodiment is shown in FIG. 14, where a rod 1415 is shaped as a square, and a hole 1416 is shaped as a matching square so that an organizer 1401 and a wall mount 1400 can only be joined at four discrete positions at 90° increments relative to each other: 0°, 90°, 180° and 270°. Otherwise, wall mount 1400 and organizer 1401 are constructed in substantially the same manner as wall mount 100 and organizer 101. As such, wall mount 1400 includes holes 1405, sockets 1406, sides 1414 and a side 1450, while organizer 1401 includes a hair dryer holder 1408, a curling iron holder 1409 and a flat iron (or hair straightener) holder 1410. In other embodiments, rod 1415 and hole 1416 take the shape of other polygons, e.g., rectangles, hexagons or octagons. Regardless of the particular shape chosen, such embodiments allow organizer 1401 to be supported in multiple rotational positions relative to wall mount 1400 (as with organizer 101 and wall mount 100).

In one embodiment, rod 115 and hole 116 are configured such that they lock into place with a twist, using a notch on rod 115 that fits into a groove in hole 116 that then fits into a lateral slot inside hole 116, thereby locking wall mount 100 and organizer 101 in place. In another embodiment, rod 115 and hole 116 use friction as the locking mechanism.

In one embodiment, multiple attachment points are used to join organizer 101 and wall mount 100. In one embodiment, more than one organizer 101 is joined to wall mount 100.

Based on the above, it should be readily apparent that the present invention provides a way to reduce clutter, disorganization and counterspace use in the bathroom while adding more electrical outlets. While certain preferred embodiments of the present invention have been set forth, it should be understood that various changes or modifications could be made without departing from the spirit of the present invention. In general, the invention is only intended to be limited by the scope of the following claims.

The invention claimed is:

1. A hair care organizing apparatus comprising:

a wall tap configured to be mounted to an electrical outlet installed in a wall, the wall tap including a plug configured to be inserted into a socket of the electrical outlet and at least one electrical socket configured to receive a plug of an electrically-powered device; and an organizer unit including at least first and second separate and distinct unaligned holders not sharing a common space and being configured to receive and support distinct hair care accessories, with the first holder being configured for a hair dryer, and said organizer unit being attached to the wall tap, wherein the organizer unit is configured to be only indirectly mounted to the wall through the wall tap and wherein the wall tap further includes a first coupler, the organizer unit further includes a second coupler, and the first and second couplers are interconnected to removably support the organizer unit from the wall tap and to enable rotational repositioning of the organizer unit relative to the wall tap.

2. The apparatus of claim 1, wherein the second holder is configured to receive and support a hair styling tool other than a hair dryer.

3. The apparatus of claim 2, wherein the second holder is configured to receive and support a curling iron or hair straightener.

4. The apparatus of claim 2, wherein the organizer unit further includes a third holder configured to receive and support a hair styling tool other than a hair dryer.

5. The apparatus of claim 1, wherein the first holder includes a member defining a passageway, with the member being configured such that a nozzle portion of the hair dryer will extend all the way through the passageway when the hair dryer is received in and supported by the first holder.

6. The apparatus of claim 1, wherein the organizer unit is cantilevered from the wall tap.

7. The apparatus of claim 6, wherein one of the first and second couplers constitutes a hole, and the other of the first and second couplers constitutes a projection configured to be snugly received in the hole.

8. The apparatus of claim 7, wherein the hole is polygonal, and the projection is polygonal such that the organizer unit can be supported in multiple rotational positions relative to the wall tap.

9. The apparatus of claim 1, wherein the wall tap further includes a pair of spaced holes configured to be aligned with threaded holes of the electrical outlet when the plug of the wall tap is inserted into the socket of the electrical outlet, said apparatus further comprising a pair of screws each configured to be inserted into a respective one of said pair of spaced holes and into a respective one of said threaded holes of the electrical outlet to secure the wall tap to the electrical outlet.

10. The apparatus of claim 1, wherein the wall tap includes a plurality of electrical sockets.

11. A hair care organizing apparatus comprising:

a wall tap including a plug configured to be inserted into a socket of an electrical outlet and at least one electrical socket configured to receive a plug of an electrically-powered device; and an organizer unit including at least first and second distinct unaligned holders not sharing a common space and being configured to receive and support distinct hair care accessories, with the first holder being configured for a hair dryer, and said organizer unit being attached to the wall tap, wherein the wall tap further includes a first coupler, the organizer unit further includes a second coupler, and the first and second couplers are interconnected to removably support the organizer unit from the wall tap and to enable rotational repositioning of the organizer unit relative to the wall tap and wherein the wall tap includes a plurality of electrical sockets and has a plurality of facets, including at least a wide facet and a narrow facet which are angled relative to one another, with the plurality of electrical sockets being located on the wide facet of the plurality of facets and the organizer unit being attached to the wall tap along the narrow facet of the plurality of facets.

12. A method of organizing hair care accessories comprising:

mounting a wall tap to an electrical outlet installed in a wall, said mounting including inserting a plug of the wall tap into a socket of the electrical outlet, wherein the wall tap includes at least one electrical socket configured to receive a plug of an electrically-powered device; and attaching an organizer unit to the wall tap such that the organizer unit is only indirectly to the wall through the wall tap, wherein the wall tap further includes a first coupler, the organizer unit further includes a second coupler, and attaching the organizer unit to the wall includes interconnecting the first and second couplers to removably support the organizer unit from the wall tap and to enable rotational repositioning of the organizer unit relative to the wall tap wherein the organizer unit includes at least first and second separate and distinct unaligned holders not sharing a common space and being configured to receive and support distinct hair care accessories, and wherein the first holder is configured for a hair dryer.

13. The method of claim 12, further comprising:

plugging a hair dryer into the at least one electrical socket; and inserting the hair dryer into the first holder to support the hair dryer from the organizer unit; and wherein the second holder is configured to receive and support a hair styling tool other than a hair dryer, the method further comprising:

plugging the hair styling tool into the electrical outlet; and inserting the hair styling tool into the second holder.

14. The method of claim 13, wherein inserting the hair styling tool into the second holder includes inserting a curling iron or hair straightener into the second holder.

15. The method of claim 12, wherein the first holder includes a member defining a passageway, and a hair dryer is inserted into the first holder such that a nozzle portion of the hair dryer extends all the way through the passageway.

16. The method of claim 12, wherein one of the first and second couplers constitutes a hole, the other of the first and second couplers constitutes a projection, and interconnecting the first and second couplers includes causing the projection to be snugly received in the hole.

17. The method of claim 12, wherein the wall tap further includes a pair of spaced holes configured to be aligned with threaded holes of the electrical outlet when the plug of the wall tap is inserted into the socket of the electrical outlet, said method further comprising inserting each of a pair of screws into a respective one of said pair of spaced holes and into a respective one of said threaded holes of the electrical outlet to secure the wall tap to the electrical outlet.

18. The method of claim 12, wherein the wall tap includes a plurality of electrical sockets and has a plurality of facets, including at least a wide facet and a narrow facet which are angled relative to one another, the plurality of electrical sockets is located on the wide facet of the plurality of facets, and attaching the organizer unit to the wall tap includes attaching the organizer unit to the wall tap along the narrow facet of the plurality of facets.

* * * * *